US010697693B2

(12) United States Patent
Lee et al.

(10) Patent No.: US 10,697,693 B2
(45) Date of Patent: Jun. 30, 2020

(54) REFRIGERATOR

(71) Applicant: Samsung Electronics Co., Ltd, Gyeonggi-do (KR)

(72) Inventors: Jong Ho Lee, Yongin-si (KR); Geon Hee Lee, Suwon-si (KR); Jee-Hoon Lee, Seoul (KR); Jea Won Lee, Hwaseong-si (KR); Wan-Ku Kang, Uiwang-si (KR); Nan Soo Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 225 days.

(21) Appl. No.: 15/833,772

(22) Filed: Dec. 6, 2017

(65) Prior Publication Data

US 2018/0164027 A1 Jun. 14, 2018

(30) Foreign Application Priority Data

Dec. 8, 2016 (KR) ..... 10-2016-0166756

(51) Int. Cl.

*F25D 23/02* (2006.01)
*F25D 11/00* (2006.01)
*F25D 23/08* (2006.01)

(52) U.S. Cl.

CPC ..... *F25D 23/028* (2013.01); *F25D 11/00* (2013.01); *F25D 23/02* (2013.01); *F25D 23/087* (2013.01); *F25D 2323/021* (2013.01)

(58) Field of Classification Search

CPC ..... F25D 23/028; F25D 23/02; F25D 11/00
See application file for complete search history.

(56) References Cited

U.S. PATENT DOCUMENTS 5,425,205 A 6/1995 Ha
6,375,291 B1 * 4/2002 Nam ..... E05B 17/0033 16/412

(Continued)

FOREIGN PATENT DOCUMENTS

CN 105865120 A 8/2016
CN 105865122 A 8/2016

(Continued)

OTHER PUBLICATIONS

European Search Report dated May 4, 2018 in connection with European Patent Application No. 17 20 5282.

*Primary Examiner* — Kimberley S Wright

(57) ABSTRACT

Disclosed herein is a refrigerator including a sliding bar provided in each of a pair of doors and that moves between standby and contact positions to which the sliding bar moves from the standby position to seal a gap between the doors, and a moving device that operates the sliding bar in linkage with operations of opening and closing the doors, wherein the moving device includes a lever that is pressed by the main body and rotatably provided inside the doors to transmit a pressing force in a direction different from a direction in which the lever is pressed by the main body, and a sliding link that operates in linkage with rotation of the lever and configured so that the sliding bar moves between the standby position and the contact position. Through this configuration, the refrigerator minimizes noise related to opening and closing the doors and improves insulation performance.

20 Claims, 15 Drawing Sheets

(56) References Cited

U.S. PATENT DOCUMENTS

| | | | | |
|---|---|---|---|---|
| 8,132,876 | B2 * | 3/2012 | An | F25D 23/028 312/405 |
| 8,469,469 | B2 * | 6/2013 | Kim | E05B 17/0029 312/319.5 |
| 10,302,350 | B2 * | 5/2019 | Read | F25D 23/028 |
| 2008/0066481 | A1 * | 3/2008 | An | F25D 23/028 62/265 |
| 2012/0146479 | A1 * | 6/2012 | An | F25D 23/028 312/405 |
| 2016/0273826 | A1 * | 9/2016 | Lee | F25D 11/00 |
| 2016/0313050 | A1 * | 10/2016 | Yoon | F25D 11/02 |
| 2017/0191738 | A1 * | 7/2017 | Jung | E05C 5/00 |
| 2018/0209209 | A1 * | 7/2018 | Ham | E06B 7/215 |
| 2018/0299186 | A1 * | 10/2018 | Jin | F25D 23/02 |
| 2019/0063820 | A1 * | 2/2019 | Read | F25D 23/028 |
| 2019/0170427 | A1 * | 6/2019 | Baum | F25D 23/028 |
| 2019/0257572 | A1 * | 8/2019 | Yoon | E06B 7/18 |

FOREIGN PATENT DOCUMENTS

| | | | |
|---|---|---|---|
| JP | 2005337680 | A | 12/2005 |
| JP | 2008185239 | A | 8/2008 |
| KR | 1020060094820 | A | 8/2006 |

* cited by examiner

REFRIGERATOR

CROSS-REFERENCE TO RELATED APPLICATION

The present application is related to and claims priority to Korean Patent Application No. 10-2016-0166756 filed on Dec. 8, 2016, the disclosure of which is incorporated herein by reference.

TECHNICAL FIELD

Embodiments of the present disclosure relate to a refrigerator, and more particularly, to a refrigerator with an improved door structure.

BACKGROUND

Generally, a refrigerator is a home appliance capable of keeping food fresh and includes a storage compartment configured to store food and a cold air supply device configured to supply cold air to the storage compartment.

Types of refrigerator may be classified in accordance with forms of a storage compartment and a door.

The types of refrigerator include a top-mounted-freezer (TMF) type refrigerator in which a storage compartment is divided into top and bottom sections by a horizontal partition and a freezer compartment and a refrigerator compartment are formed at the top section and the bottom section, respectively, and a bottom-mounted-freezer (BMF) type refrigerator in which a refrigerator compartment is formed at a top section and a freezer compartment is formed at a bottom section.

The types of refrigerator also include a side-by-side (SBS) type refrigerator in which a storage compartment is divided into left and right sections by a vertical partition and a freezer compartment and a refrigerator compartment are formed at one side and the other side, respectively, and a French door refrigerator (FDR) type refrigerator in which a storage compartment is divided into top and bottom sections by a horizontal partition, a refrigerator compartment and a freezer compartment are formed at the top section and the bottom section, respectively, and the refrigerator compartment at the top section is opened and closed by a pair of doors.

A gasket is provided at a door of a refrigerator to seal a gap between the door and a main body when the door is closed.

However, in the FDR type refrigerator, because the refrigerator compartment at the top section is opened and closed by the pair of doors and a vertical partition is not provided in the refrigerator compartment, it is not possible to seal a gap between the pair of doors with a gasket. Consequently, a rotary bar that is rotatably installed in any one of the pair of doors is applied to the FDR type refrigerator such that the gap between the pair of doors can be sealed.

However, in the FDR type refrigerator, there are problems such as a high noise generation when the rotary bar collides with the doors and a main body of the refrigerator while opening and closing the doors, and a malfunction of the rotary bar.

SUMMARY

To address the above-discussed deficiencies, it is a primary object to provide a refrigerator with an improved structure for sealing a door.

It is another aspect of the present disclosure to provide a refrigerator with improved insulation performance.

Additional aspects of the disclosure will be set forth in part in the description which follows and, in part, will be obvious from the description, or may be learned by practice of the disclosure.

In accordance with one aspect of the present disclosure, a refrigerator includes a main body having a storage compartment, a pair of doors configured to open and close the storage compartment, a sliding bar provided in each of the pair of doors and configured to move between a standby position and a contact position to which the sliding bar moves from the standby position to seal a gap between the pair of doors, and a moving device configured to operate the sliding bar in linkage with an operation of opening or closing the doors, wherein the moving device includes a lever configured to be pressed by the main body and rotatably provided inside the doors to transmit a pressing force in a direction different from a direction in which the lever is pressed by the main body, and a sliding link configured to operate in linkage with rotation of the lever and configured so that the sliding bar moves between the standby position and the contact position.

The moving device may further include an intermediate link configured to operate in linkage with the lever and provided to be movable in a first direction perpendicular to the direction in which the lever is pressed by the main body, and the sliding link may be configured to convert movement of the intermediate link in the first direction into movement in a second direction, which is a direction perpendicular to the first direction and in which the sliding bar moves between the standby position and the contact position.

The sliding link may have one end rotatably provided in the intermediate link and the other end rotatably provided in the sliding bar.

The sliding bar may be disposed to be parallel to the moving device in the second direction.

The sliding link may include a first link rotatably provided in the intermediate link, a second link configured to move relative to the first link, and a link elastic member configured to generate an elastic force in a longitudinal direction in the sliding link between the first link and the second link.

The moving device may further include a lever elastic member provided to elastically return the lever and configured to generate an elastic restoration force in the first direction when the storage compartment is closed by the doors.

The moving device may further include an elastic member provided to elastically return the intermediate link and configured to generate an elastic restoration force in the first direction when the storage compartment is closed by the doors.

The lever may be configured so that movement thereof is limited by an inner wall of the storage compartment when the storage compartment is closed by the doors.

The sliding bar may include a pair of sliding bars respectively provided in the pair of doors, and the pair of sliding bars may include first and second magnets disposed at opposite surfaces to come into contact with each other at the contact position.

The first and second magnets may be configured to be spaced a predetermined distance apart from each other at the contact position.

The refrigerator may further include a housing forming an accommodation space so that the sliding bar is accommodated therein at the standby position, and a sealing rib configured to divide the accommodation space.

The sealing rib may extend in a longitudinal direction of the sliding bar and the housing and have one side fixed to the housing and the other side fixed to the sliding bar.

The sealing rib may be provided to bend in accordance with whether the sliding bar is at the standby position or the contact position.

In accordance with another aspect of the present disclosure, a refrigerator includes a main body having a storage compartment, a pair of doors configured to open and close the storage compartment, a sliding bar configured to seal a gap between the pair of doors, and a moving device provided in the doors to operate the sliding bar in linkage with operations of opening and closing the doors, wherein the moving device includes a lever pressed by the main body, an intermediate link configured to operate in linkage with the lever and provided to be movable in a first direction perpendicular to a direction in which the lever is pressed by the main body, and a sliding link configured to operate in linkage with the intermediate link and convert a pressing force transmitted in the first direction into movement in a second direction perpendicular to the first direction to move the sliding bar in the second direction.

The sliding link may have one end rotatably provided in the intermediate link and the other end rotatably provided in the sliding bar.

The sliding bar may be configured to move between a standby position at which the sliding bar is accommodated in the doors when the storage compartment is opened by the doors and a contact position to which the sliding bar moves from the standby position in the second direction to protrude from the doors when the storage compartment is closed by the doors.

The sliding bar may be disposed to be parallel to the moving device in the second direction.

The doors may include an outer case and an inner case coupled to the outer case and having at least a portion accommodated in the storage compartment when the storage compartment is closed by the doors, and the lever may be provided to protrude higher than the portion of the inner case accommodated in the storage compartment and provided so that an operation thereof is restrained by an inner wall of the storage compartment in the storage compartment closed by the doors.

In accordance with still another aspect of the present disclosure, a refrigerator includes a main body having a storage compartment, and a pair of doors configured to open and close the storage compartment and having a bar assembly configured to fill a space between the pair of doors when the storage compartment is closed by the doors, wherein the bar assembly includes a housing forming an accommodation space, a sliding bar configured to move between a standby position at which the sliding bar is inserted into the accommodation space and a sealing position to which the sliding bar moves from the standby position to protrude from one door of the pair of doors toward the other door, and a sealing rib configured to connect an inner surface of the housing forming the accommodation space and the sliding bar to each other and extending in a longitudinal direction of the bar assembly to divide the accommodation space.

The sealing rib may be provided to bend in accordance with whether the sliding bar is at the standby position or the contact position.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
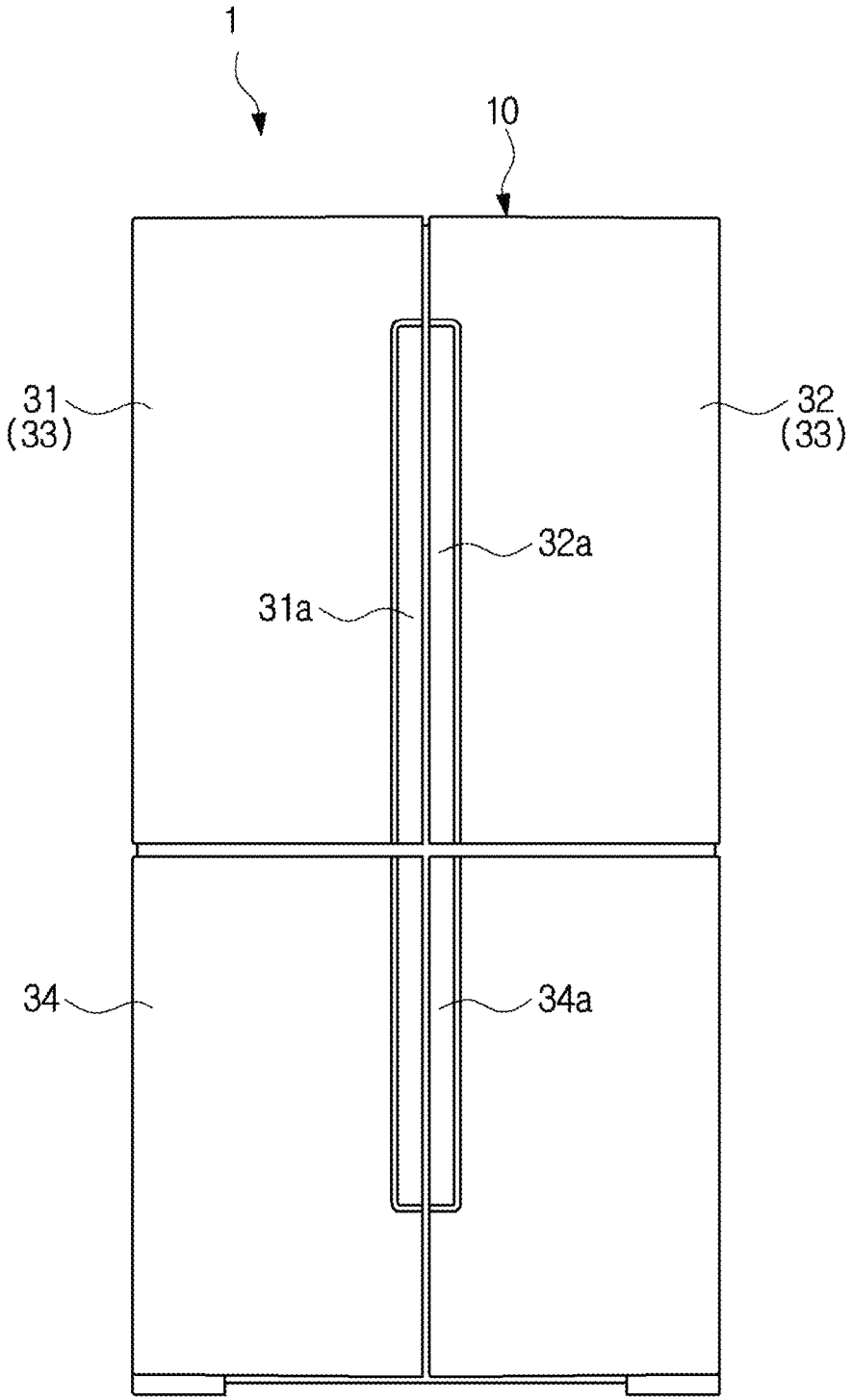
FIG. 1 is a front view of a refrigerator according to one embodiment of the present disclosure.
Figure 2:
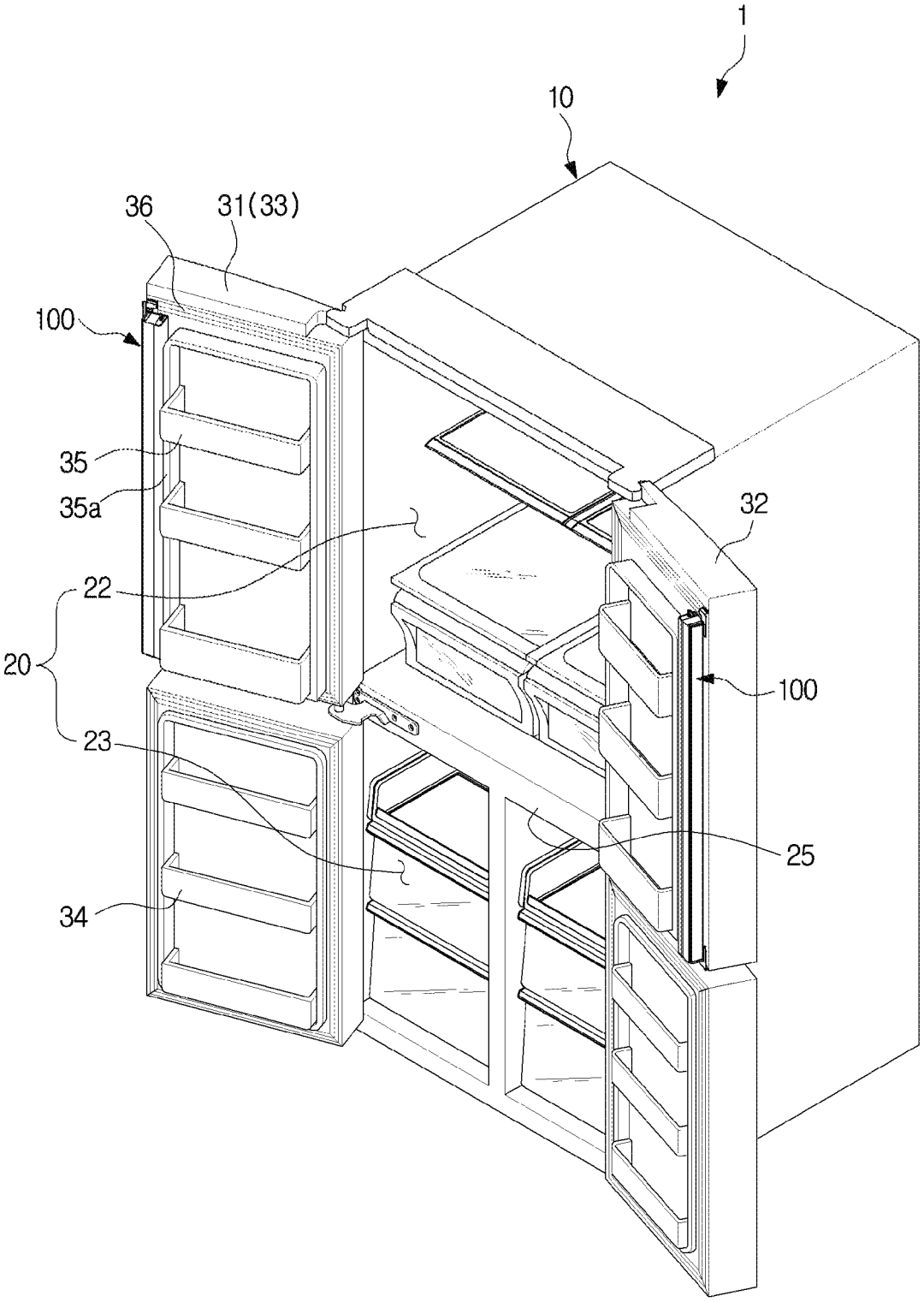
FIG. 2 is a perspective view of the refrigerator according to an embodiment of the present disclosure in a state in which doors of the refrigerator are open.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The various embodiments described herein and configurations illustrated in the drawings are merely exemplary embodiments of the present disclosure, and various modifications which may replace the embodiments and the drawings herein may be present at the time at which this application is filed.

Like reference numerals or symbols presented in the drawings of the application indicate parts or elements that perform substantially the same functions.

Terms used herein are for describing the embodiments and are not intended to limit and/or restrain the disclosure. A singular expression includes a plural expression unless context clearly indicates otherwise. In the application, terms such as "include" or "have" should be understood as designating that features, number, steps, operations, elements, parts, or combinations thereof exist and not as precluding the existence or possibility of adding one or more other features, numbers, steps, operations, elements, parts, or combinations thereof in advance.

Terms including ordinals such as "first" and "second" may be used to describe various elements, but the elements are not limited by the terms. The terms are only used for the purpose of distinguishing one element from another element. For example, a first element may be referred to as a second element, and likewise, a second element may also be referred to as a first element without departing from the scope of the present disclosure. The term "and/or" includes a combination of a plurality of described items or any one item among the plurality of described items.

Hereinafter, exemplary embodiments according to the present disclosure will be described in detail with reference to the accompanying drawings.

A refrigerator 1 includes a main body 10, a storage compartment 20 formed inside the main body 10 and divided into top and bottom sections, doors configured to open and close the storage compartment 20, and a cold air supply device (not illustrated) configured to supply cold air to the storage compartment 20.

The main body 10 may include an inner case forming the storage compartment 20, an outer case coupled to an outside of the inner case and forming an exterior of the main body 10, and an insulation material foamed between the inner case and the outer case configured to insulate the storage compartment 20.

The cold air supply device may generate cold air using the refrigeration cycle in which a refrigerant is compressed, condensed, expanded, and evaporated.

The storage compartment 20 may be provided so that a front surface thereof is open and may be divided into a refrigerator compartment 22 at an upper side and a freezer compartment 24 at a lower side by a horizontal partition 25. The refrigerator compartment 22 may be opened and closed by a pair of doors 31 and 32 rotatably coupled to the main body 10, and the freezer compartment 24 may be opened and closed by a pair of doors 34 rotatably coupled to the main body 10. Shapes of the doors are not limited, and sliding doors that open and close the compartments by sliding may be applied as the doors.

The pair of doors 31 and 32 configured to open and close the refrigerator compartment 22 may be disposed at left and right side of the front of the refrigerator compartment 22. Hereinafter, for convenience, a left door in the drawings will be referred to as a first door 31, and a right door will be referred to as a second door 32. In consideration of a relationship between the doors of the refrigerator compartment 22 and the doors of the freezer compartment 24, for convenience of description, the doors of the refrigerator compartment 22 will be referred to as upper doors 33, and the doors of the freezer compartment 24 will be referred to as lower doors 34. A first door handle 31*a* is provided at the first door 31 to be gripped for opening and closing the first door 31, and a second door handle 32*a* is provided at the second door 32 to be gripped for opening and closing the second door 32. A lower door handle 34*a* is provided at the lower doors 34 to be gripped for opening and closing the lower doors 34.

The first door 31 may open and close a left portion of the refrigerator compartment 22, and the second door 32 may open and close the remaining portion of the refrigerator compartment 22. A door shelf 35 configured to store food may be provided at a rear surface of each of the first door 31 and the second door 32.

The door shelf 35 may include a shelf support 35*a* perpendicularly extending from the first door 31 to support the door shelf 35 at both left and right sides of the door shelf 35. The shelf support 35*a* may be a separate configuration that is detachable from the doors 31 and 32. In the present embodiment, the shelf support 35*a* is provided to extend from the doors 31 and 32.

Also, a gasket 36 may be provided at an edge of the rear surface of each of the first door 31 and the second door 32 to seal a gap between the first door 31 and the main body 10 and a gap between the second door 32 and the main body 10 when the first door 31 and the second door 32 are closed.

The gasket 36 may be installed in the form of a loop along the edge of the rear surface of each of the first door 31 and the second door 32 and may include a magnet (not illustrated) therein.

A gap may be formed between first door 31 and the second door 32 when the first door 31 and the second door 32 are closed, and a bar assembly 100 may be provided to seal the gap.

An operation and configuration of the bar assembly 100 will be described below.

Figure 3:
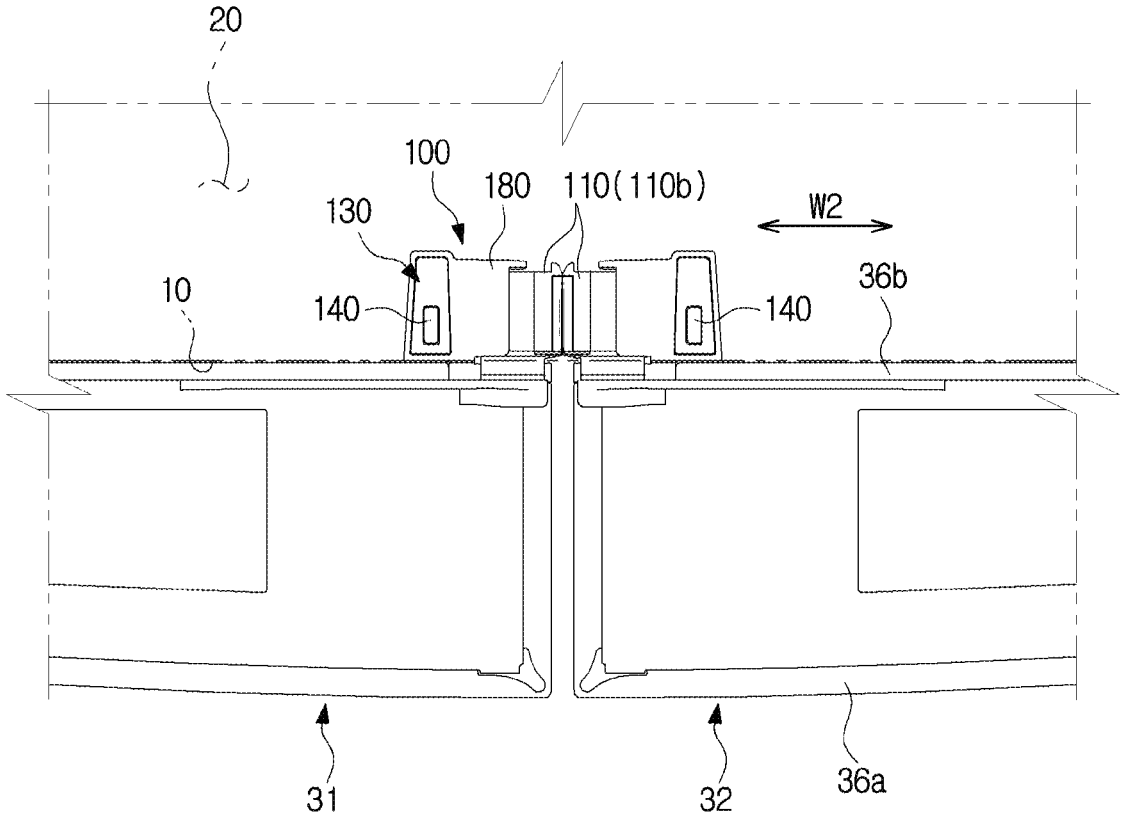
FIG. 3 is a view illustrating the refrigerator according to an embodiment of the present disclosure in a state in which a storage compartment of the refrigerator is closed.
Figure 4:
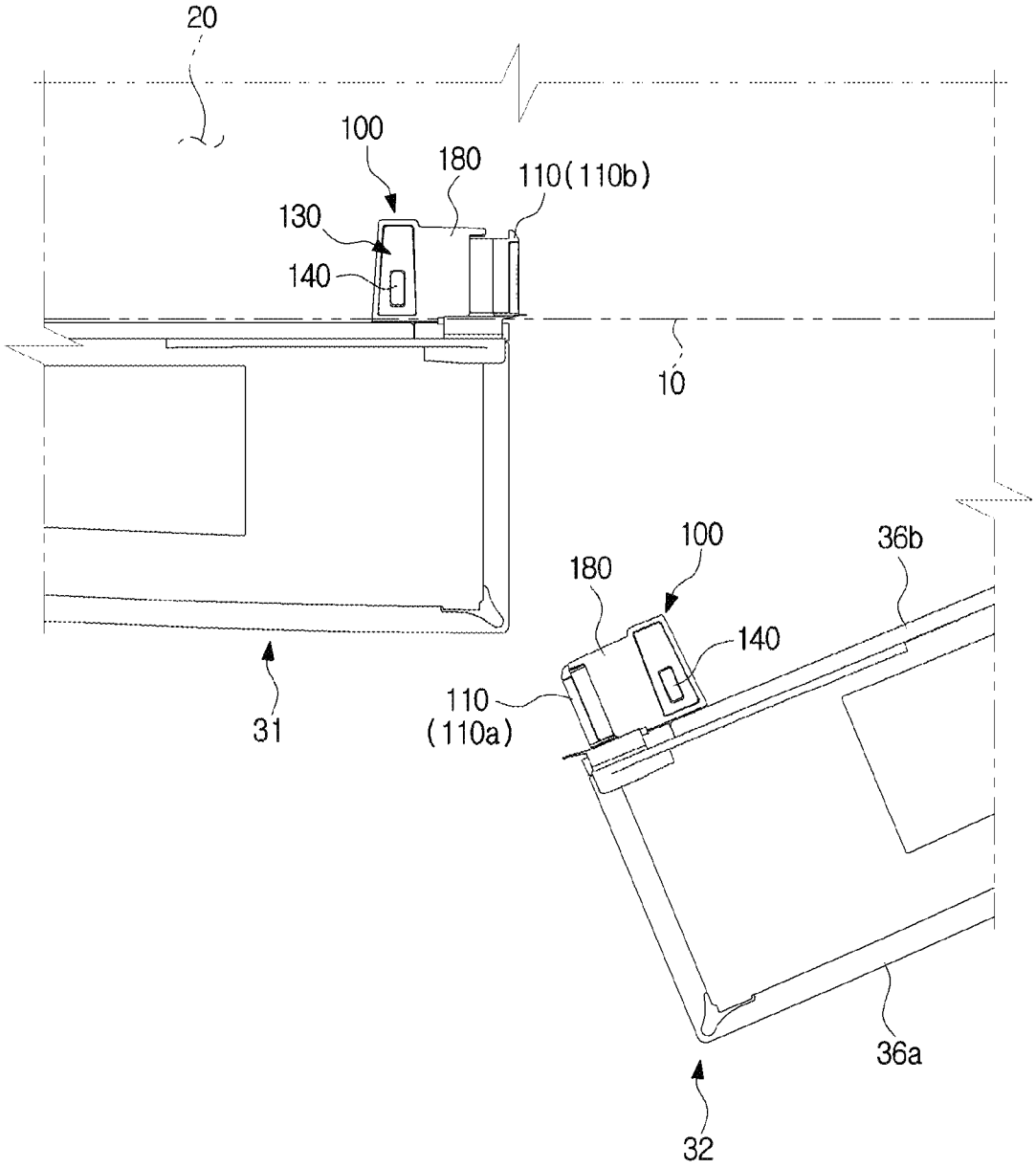
FIG. 4 is a view illustrating the refrigerator according to an embodiment of the present disclosure in a state in which any one of the doors is open.

FIG. 3 is a view illustrating the refrigerator according to an embodiment of the present disclosure in a state in which a storage compartment of the refrigerator is closed, and FIG. 4 is a view illustrating the refrigerator according to an embodiment of the present disclosure in a state in which any one of the doors is open.

The doors 31 and 32 may include the bar assembly 100. Although the bar assembly 100 will be described as being provided in the upper doors 31 and 32 for convenience of description, the bar assembly 100 may also be provide in the lower doors 34.

The bar assembly 100 may be provided in each of the first door 31 and the second door 32. Specifically, a pair of bar assemblies 100 may be provided between the first door 31 and the second door 32 to face each other. The bar assemblies 100 may be integrally formed with the doors 31 and 32 or may be formed as separate configurations that are detachable from the doors 31 and 32. The bar assemblies 100 may be configured to be accommodated in the storage compartment 20 when the storage compartment 20 is closed by the doors 31 and 32.

Each of the bar assemblies 100 may include a sliding bar 110 and a moving device 130.

The sliding bar 110 is provided to slide between the doors 31 and 32 to fill a space formed between the doors 31 and 32.

The sliding bar 110 may operate in linkage with operations of opening and closing the doors 31 and 32, and a pair of sliding bars 110 may be configured to come into contact with each other when the storage compartment 20 is closed by the doors 31 and 32, as illustrated in FIG. 3. By sealing the gap between the doors 31 and 32 in this way, the storage compartment 20 may be insulated.

Conversely, when the storage compartment 20 is opened by at least one door 32 of the doors, as illustrated in FIG. 4, the sliding bar 110 disposed at the door 32 performing the opening operation is configured to be accommodated in the door 32. In this way, by minimizing interference between the sliding bars 110, the operations of opening and closing the doors 31 and 32 may be facilitated.

Figure 5:
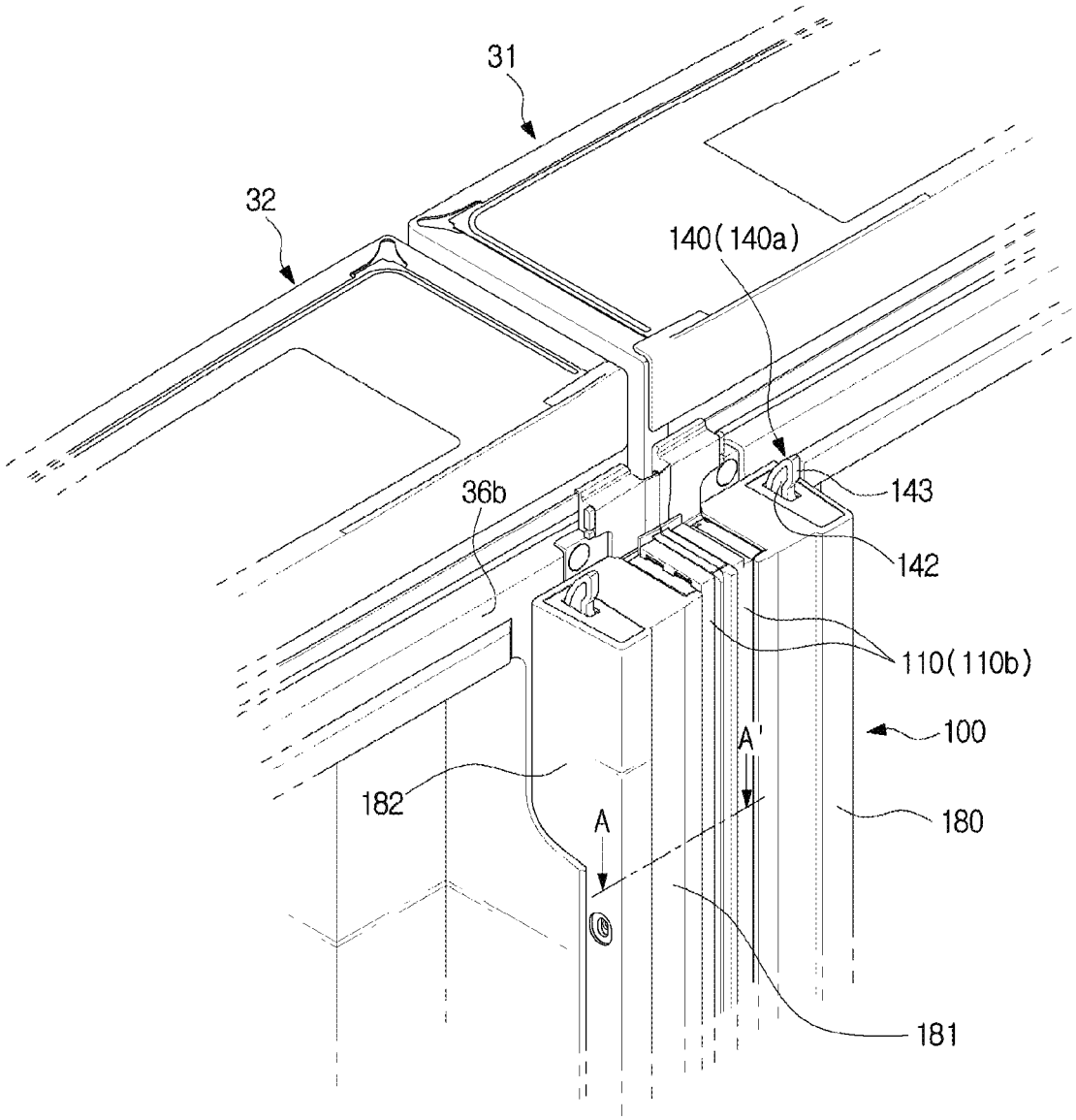
FIG. 5 is a view illustrating the doors and a bar assembly of the refrigerator according to an embodiment of the present disclosure.
Figure 6:
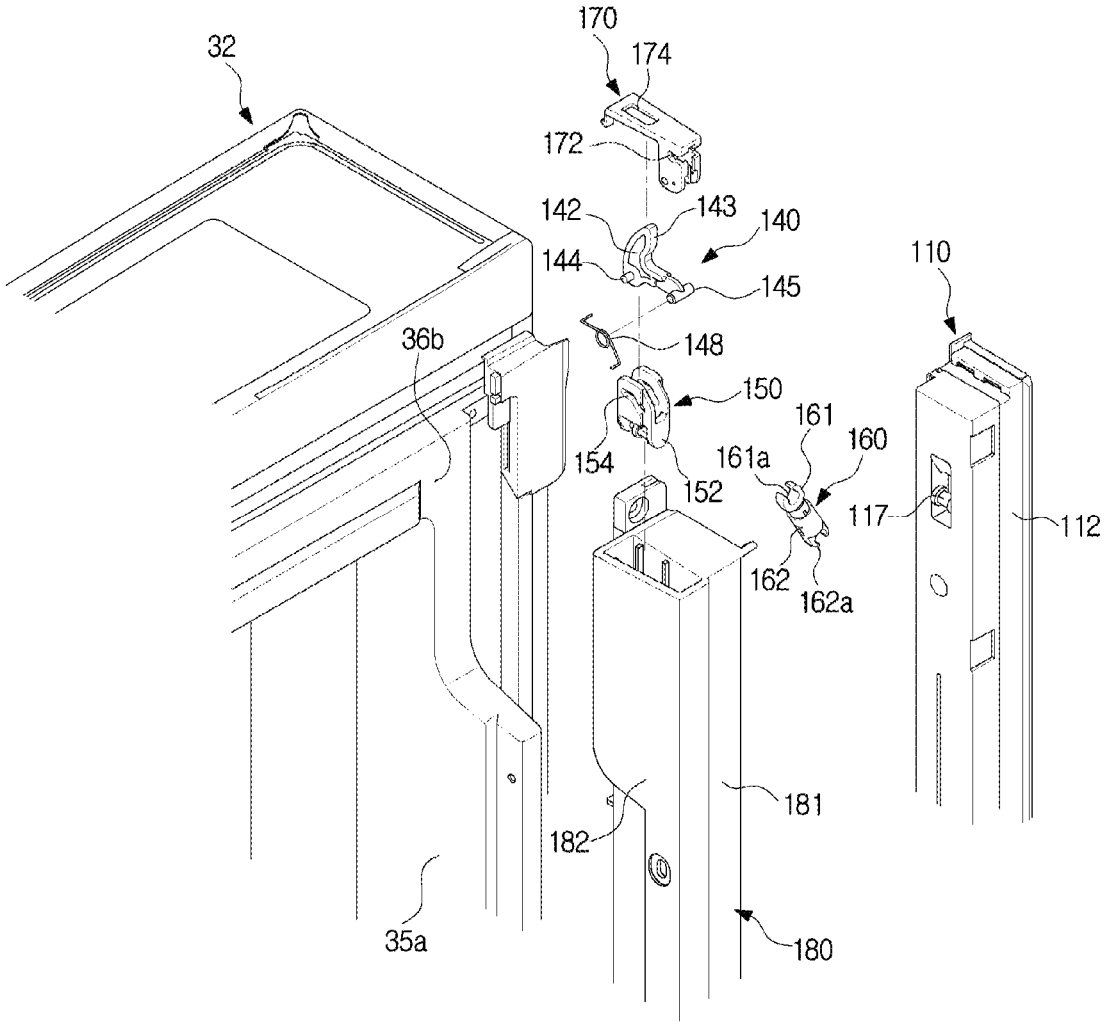
FIG. 6 is an exploded perspective view of the bar assembly of the refrigerator according to an embodiment of the present disclosure.
Figure 7:
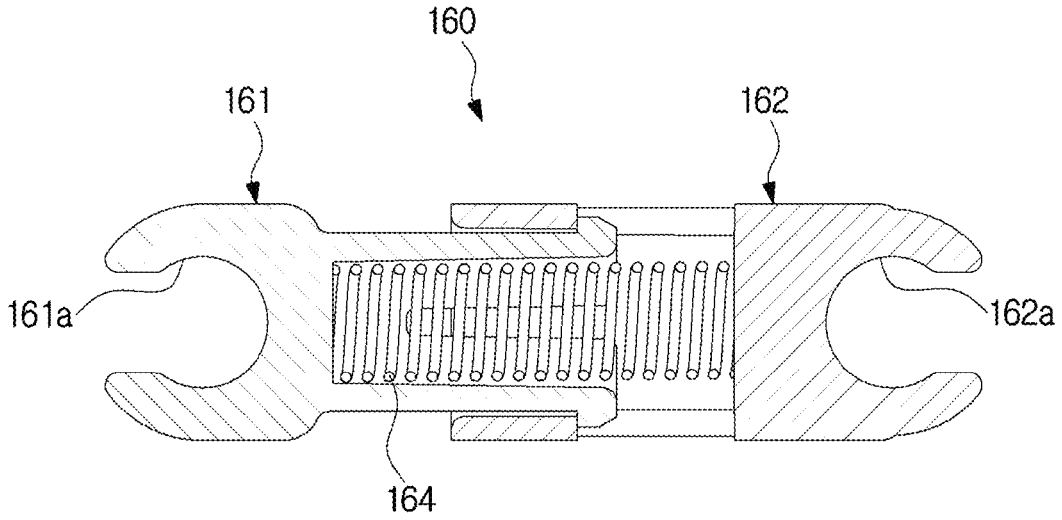
FIG. 7 is a cross-sectional view of a sliding link of the refrigerator according to an embodiment of the present disclosure.
Figure 8:
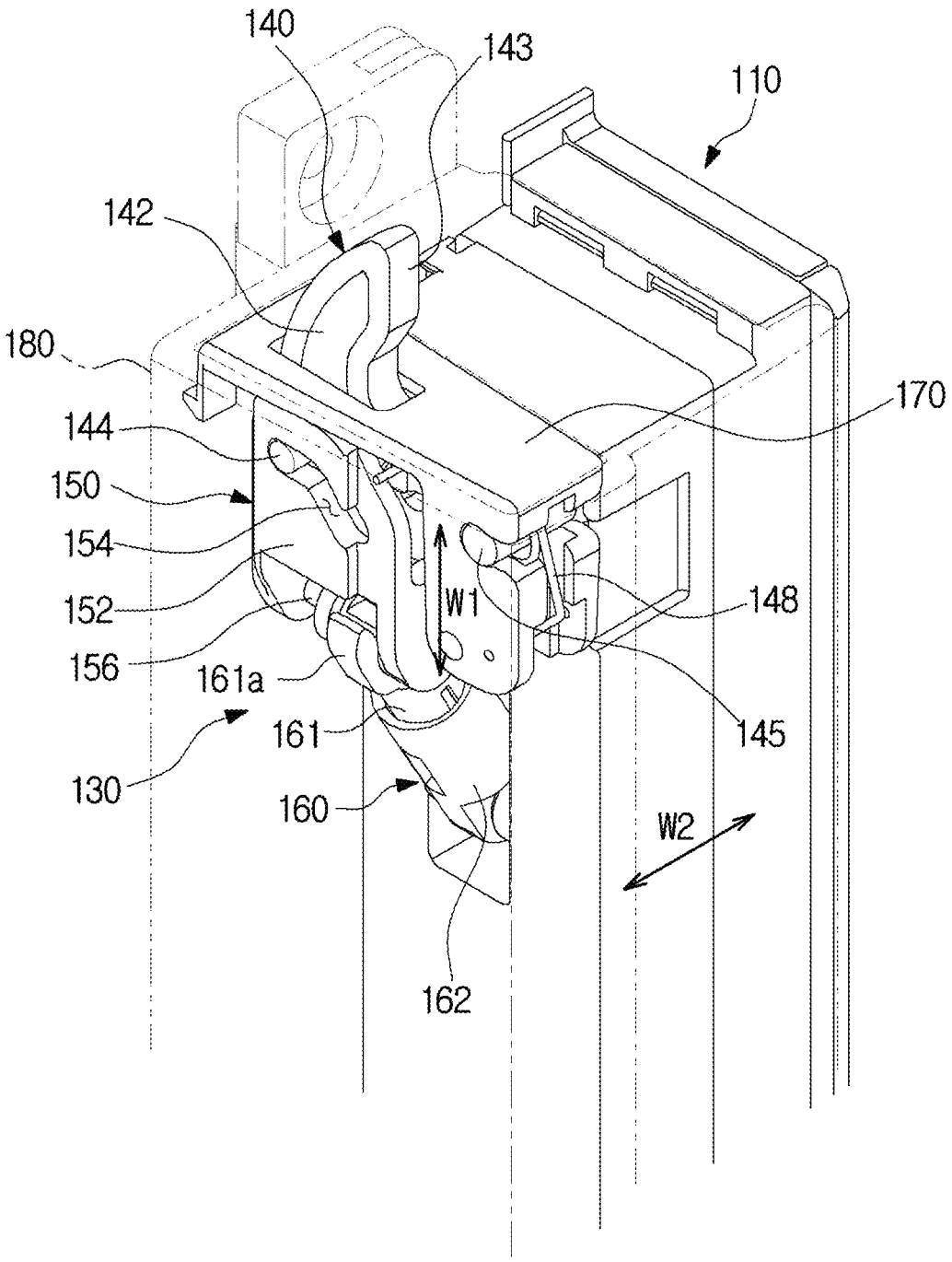
FIG. 8 is a view of a moving device of the refrigerator according to an embodiment of the present disclosure.

FIG. 5 is a view illustrating the doors and the bar assembly of the refrigerator according to an embodiment of the present disclosure, FIG. 6 is an exploded perspective view of the bar assembly of the refrigerator according to an embodiment of the present disclosure, FIG. 7 is a cross-sectional view of a sliding link of the refrigerator according to an embodiment of the present disclosure, and FIG. 8 is a view of the moving device of the refrigerator according to an embodiment of the present disclosure.

The bar assembly 100 may include a housing 180. The housing 180 forms an exterior of the bar assembly 100 and has the moving device 130 and the sliding bar 110 disposed therein. The housing 180 may include a first housing 181 in which the sliding bar 110 is disposed and a second housing 182 in which the moving device 130 is disposed. The first housing 181 and the second housing 182 may be integrally formed.

The housing 180 may form an accommodation space 183 (see FIG. 10) configured to accommodate the sliding bar 110.

The housing 180 may be integrally formed with the doors 31 and 32 or may be a separate configuration that is detachable from the doors 31 and 32. The housing 180 may also be an element of the doors that is integrally molded with the doors 31 and 32.

The sliding bar 110 may be slidably disposed at one side of the housing 180, and the moving device 130 configured to operate the sliding bar 110 may be disposed at the other side of the housing 180. The moving device 130 is configured so that the sliding bar 110 may operate in linkage with the operations of opening and closing the doors 31 and 32. The moving device 130 will be described below.

The sliding bar 110 may be formed in a bar shape. The sliding bar 110 may be formed to extend vertically in a height direction of the doors 31 and 32. That is, because the sliding bar 110 is a configuration provided to fill the space between the doors 31 and 32, the sliding bar 110 is provided to correspond to heights of the doors 31 and 32.

The sliding bar 110 may be provided to move between a standby position 110*a* and a contact position 110*b*. That is, the sliding bar 110 may move between the standby position 110*a* at which the sliding bar 110 is accommodated in the accommodation space 183 of the housing 180, and the contact position 110*b* to which the sliding bar 110 moves from the standby position 110*a* to protrude from the housing 180.

Because the sliding bar 110 does not protrude outside of the housing 180 and outside of the doors 31 and 32 when the sliding bar 110 is at the standby position 110*a*, damage to the sliding bar 110 due to external environment may be prevented. Also, the sliding bar 110 protrudes outside of the housing 180 and is able to fill the space between the doors 31 and 32 when the sliding bar 110 is at the contact position 110*b*.

A method of moving the sliding bar 110 is not limited. For example, a rail may be formed in any one of the sliding bar 110 and an inner surface of the housing 180, and a moving protrusion moving along the rail may be provided in the other one.

The moving device 130 is configured to operate the sliding bar 110 in linkage with the operations of the doors 31 and 32.

The moving device 130 may include a lever 140 and a sliding link 160.

The lever 140 is provided to protrude outside of the housing 180. Specifically, the lever 140 is provided to protrude outside of the housing 180 when the doors are at opened positions or the sliding bar 110 is at the standby position 110*a*. The lever 140 may be provided to protrude from an upper surface of the housing 180. The lever 140 may be located at a lever standby position 140*a* at which the lever 140 protrudes from the top of the housing 180 when the doors are at the opened positions, and the lever 140 may be located at a lever pressing position 140*b* (see FIG. 13) at which the lever 140 is inserted into the housing 180 when the doors are at closed positions. That is, the lever 140 may be provided to be rotatable between the lever standby position 140*a* and the lever pressing position 140*b* to transmit a pressing force in a first direction W1, which is a direction different from a direction in which the lever 140 is pressed by the main body 10.

The first door 31 and the second door 32 may include a door outer case 36*a* forming an exterior thereof and a door inner case 36*b* coupled to the door outer case 36*a* and accommodated in the storage compartment 20 when the storage compartment 20 is closed by the doors 31 and 32. The lever 140 may be accommodated in the storage compartment 20 with the door inner case 36*b*. The lever 140 is configured so that an operation thereof is restrained by an inner wall 21 (see FIG. 11) of the storage compartment 20 in the storage compartment 20 closed by the doors 31 and 32.

The lever 140 may include a lever body 142 and a lever rotating shaft 145.

The lever body 142 may have a substantially fan-like shape. The lever rotating shaft 145 forming a center of rotation of the lever 140 may be provided in the lever body 142. The lever rotating shaft 145 may be located inside the housing 180, and the lever 140 may move between the lever standby position 140*a* and the lever pressing position 140*b* due to this configuration. Specifically, the lever 140 may be provided in a lever mounting portion 170, which is an element of the housing 180, and the lever rotating shaft 145 may be rotatably provided by being mounted in a mounting hole 172 formed in the lever mounting portion 170. The lever mounting portion 170 may include a lever hole 174 such that the lever 140 is exposed outside of the housing 180.

A pressed surface 143 pressed by the main body 10 of the refrigerator may be provided at a portion of the lever body 142 protruding outside of the housing 180. A lever transmitting portion 144 configured to transmit a pressing force to an intermediate link 150, which will be described below, may be provided at a side of the lever body 142 opposite the pressed surface 143.

The lever transmitting portion 144 may be formed in a protruding shape, and the pressing force may be transmitted to the intermediate link 150 by the lever transmitting portion 144.

The sliding link 160 is configured to operate in linkage with rotation of the lever 140 and is configured to restrain an operation of the sliding bar 110 so that the sliding bar 110 moves between the standby position 110*a* and the contact position 110*b*. The sliding link 160 is configured to convert a pressing force applied to the lever 140 into sliding movement of the sliding bar 110.

The moving device 130 may include the intermediate link 150.

The intermediate link 150 has one side connected to the lever 140 and the other side connected to the sliding link 160. The intermediate link 150 is configured to convert rotation of the lever 140 into movement in the first direction W1, which is the vertical direction.

The intermediate link 150 may include an intermediate link body 152 and a guide rail 154 formed in the intermediate link body 152.

The guide rail 154 is provided to such that the lever transmitting portion 144 of the lever 140 moves. Because the lever 140 rotates and the intermediate link 150 linearly moves, the guide rail 154 is provided so that at least a portion thereof has an inclined section such that the intermediate link 150 may receive the pressing force without interfering with the operation of the lever 140. Specifically, the guide rail 154 is provided so that at least a portion thereof has a section inclined in the first direction W1. The guide rail 154 is provided so that the lever transmitting portion 144 moves along the section formed in the guide rail 154. However, embodiments are not limited thereto. The guide rail 154 may be provided in the lever 140, and the protrusion moving along the guide rail 154 may be provided in the intermediate link 150.

The sliding link 160 may have one side rotatably provided in the intermediate link 150 and the other side rotatably provided in the sliding bar 110. The sliding link 160 may have a substantially column-like shape. The sliding link 160 is configured to convert an operation of the intermediate link 150 moving in the first direction W1 into an operation of the sliding bar 110 moving in a second direction W2.

The sliding link 160 may include a first link 161 and a second link 162.

The first link 161 may include a first link hook 161*a* to be rotatably coupled to a first link locking portion 156 configured in the intermediate link 150. The second link 162 may include a second link hook 162*a* to be rotatably coupled to a second link locking portion 117 configured in the sliding bar 110.

A link elastic member 164 may be provided in the first link 161 and the second link 162. The link elastic member 164 is provided to elastically support the first link 161 and the second link 162. In a state in which any one door 31 of the doors 31 and 32 is closed and the other door 32 is open, the sliding bars 110 may collide when the other door 32 is closed. By imparting an elastic force between the first link 161 and the second link 162, the link elastic member 164 may absorb an impact between the sliding bars 110 and prevent damage to the sliding bars 110 due to the impact. Also, the link elastic member 164 may reduce noise due to an impact transmitted to the sliding bars 110.

The sliding bar 110 may be disposed in parallel to the moving device 130 in the second direction W2. When the sliding bar 110 and the moving device 130 are disposed in a front-rear direction, a front-rear thickness of the bar assembly 100 increases. By the sliding bar 110 and the moving device 130 being disposed parallel to each other in the second direction W2, the configuration of the bar assembly 100 may be simplified and the sliding bar 110 may be thicker than a rotary bar. In this way, insulation performance of the sliding bar 110 may be improved.

The moving device 130 may include a lever elastic member 148.

The lever elastic member 148 is provided at the lever rotating shaft 145 to elastically return the lever 140 to the lever standby position 140*a* when a restraint on the lever 140 is released at the lever pressing position 140*b*. Specifically, when the doors are open, the restraint on the lever 140 by the inner wall 21 of the storage compartment 20 is released and the lever 140 is elastically returned from the lever pressing position 140*b* to the lever standby position 140*a*.

Figure 9:
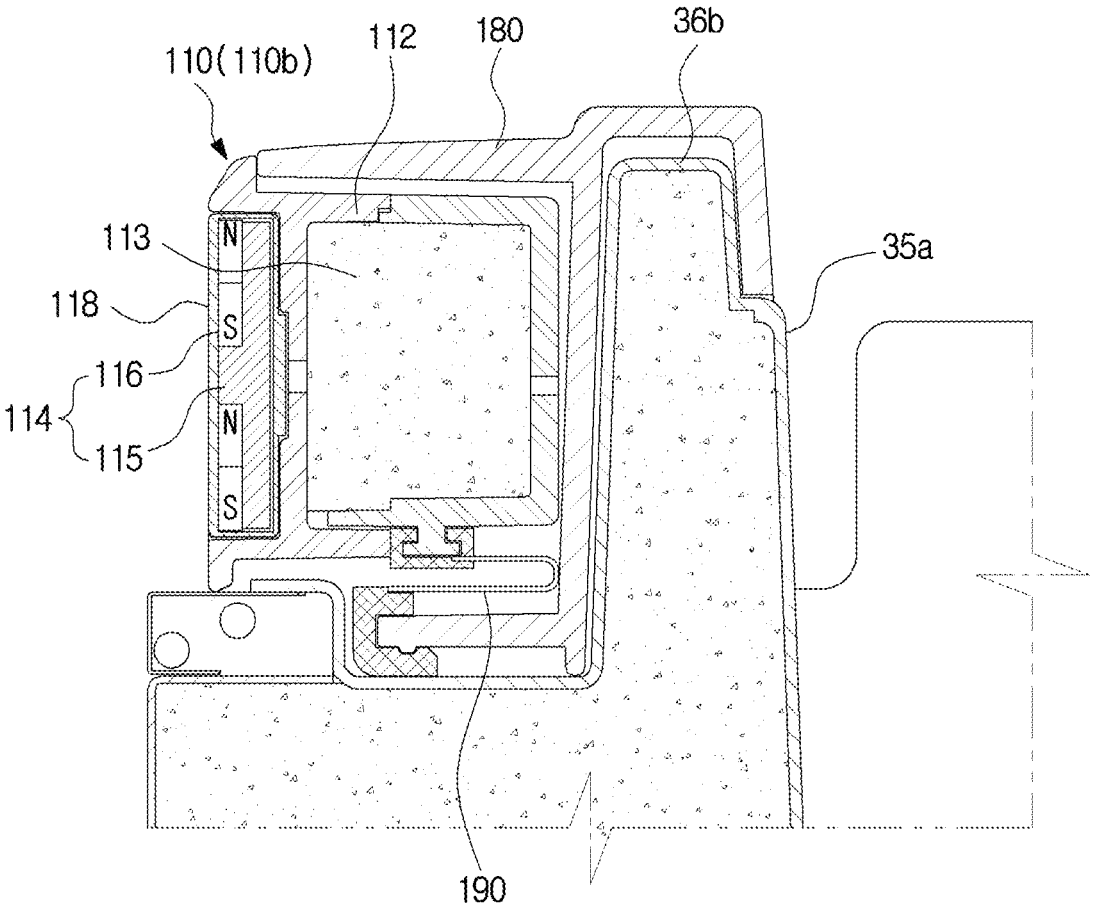
FIGS. 9 and 10 are a view of an operation of the sliding bar and a cross-sectional view taken along line A-A' in FIG. 5.
Figure 10:
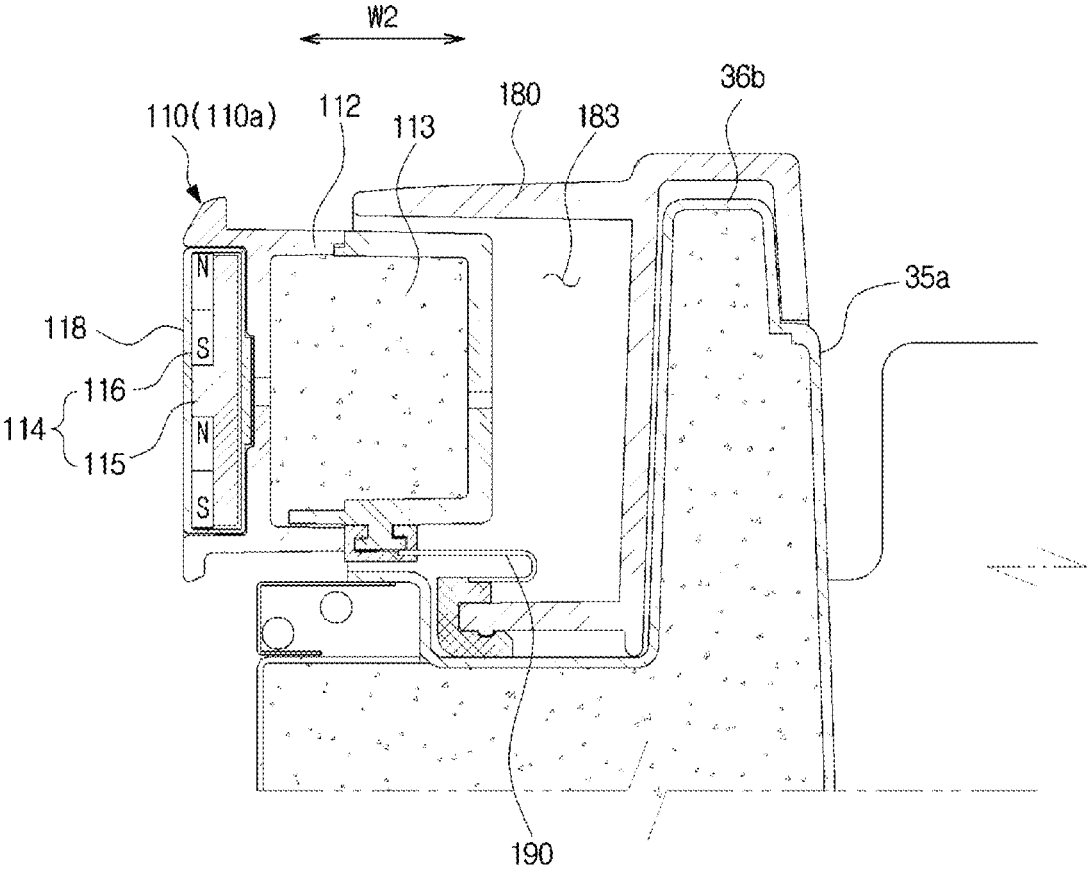

FIGS. 9 and 10 are a view of an operation of the sliding bar and a cross-sectional view taken along line A-A' in FIG. 5.

The sliding bar 110 may include a bar body 112 and a magnetic unit 114.

An insulation material 113 may be provided inside the bar body 112 to insulate the sliding bar 110. When the bar assembly 100 is formed as a rotary bar that rotates, there is a limitation on increasing a thickness of the rotary bar to insulate the rotary bar due to a rotating structure of the rotary bar. However, because the sliding bar 110 slides between the doors, a limitation on increasing the thickness of the sliding bar 110 to insulate the sliding bar 110 may be reduced.

The magnetic unit 114 may be disposed at one side of the bar body 112. The magnetic unit 114 may include a unit body 115 and at least one magnet 116 provided inside the unit body 115. The unit body 115 may be coupled to the bar body 112 so that a contact surface 118 is exposed to the outside. The unit body 115 may be integrally formed with the bar body 112 or may be detachable from the bar body 112. A pair of contact surfaces 118 formed in the pair of sliding bars 110 may come into contact with each other when the storage compartment 20 is closed by the doors.

The at least one magnet 116 may be disposed inside the unit body 115 and, specifically, may be located at an inner side of the contact surface 118. The magnet 116 disposed in any one sliding bar 110 and another magnet 116 disposed in the other sliding bar 110 may be disposed so that different polarities face each other. For example, when the magnet 116 is disposed in the first door 31 such that an N-pole is disposed outward from the door and an S-pole is disposed inward from the door, the other magnet 116 may be disposed in the second door 32 such that an S-pole is disposed outward from the door and an N-pole is disposed inward from the door. By such an arrangement of the magnets 116, the sliding bars 110 may come into contact with each other.

When any one of the doors is open, the inward polarity of the magnet 116 disposed in the door that is open becomes equal to the outward polarity of the other magnet 116 disposed in the closed door. Through such a configuration, interference between the sliding bars 110 may be prevented due to a repulsive force between the magnets 116.

The at least one magnet 116 provided in any one of the doors 31 and 32 may be provided to be spaced a predetermined distance apart from the other magnet 116 provided in the other door. Specifically, when the sliding bars 110 are at the contact position 110*b*, the magnets 116 are spaced the predetermined distance apart from each other inside the unit body 115 due to a thickness of the unit body 115. In a case in which a magnetic force between the magnets 116 strongly acts on the doors, when any one of the doors is opened, the other door may also be opened due to the magnetic force. To prevent this, a magnetic force between a first magnet 116 and a second magnet 116 may be adjusted by adjusting the thickness of the unit body 115.

The bar assembly 100 may include a sealing rib 190. The sliding bar 110 is provided in the housing 180 to slide between the standby position 110*a* and the contact position 110*b*. A gap having a predetermined distance for movement may be formed between the housing 180 and the sliding bar 110 to facilitate movement of the sliding bar 110. The sealing rib 190 may block outside air from being introduced via the gap and prevent discharge of air inside the storage compartment 20 via the gap by dividing the accommodation space 183. The sealing rib 190 may be bendable. The sealing rib 190 may be formed with an elastic material.

The sealing rib 190 may be provided in a space between the sliding bar 110 and the housing 180. The sealing rib 190 may have one side fixed to an inside of the housing 180 and the other side fixed to the sliding bar 110. The sealing rib 190 may be provided to be bendable in consideration of movement of the sliding bar 110. That is, the sealing rib 190 may be disposed in a bent state inside the housing 180 when the sliding bar 110 is at the standby position 110*a* and may be disposed in a state in which at least a portion thereof is unfolded when the sliding bar 110 is at the contact position 110*b*. By this configuration, the sealing rib 190 is provided such that the sealing rib 190 remains fixed to the inside of the housing 180 and the sliding bar 110 regardless of whether the sliding bar 110 is at the standby position 110*a* or the contact position 110*b*.

The sealing rib 190 may extend perpendicularly in a longitudinal direction of the sliding bar 110.

Hereinafter, an operation of the bar assembly 100 of the refrigerator of the present disclosure will be described.

FIGS. 11 to 14 are views of operations of the bar assembly and the doors of the refrigerator according to an embodiment of the present disclosure.

Figure 11:
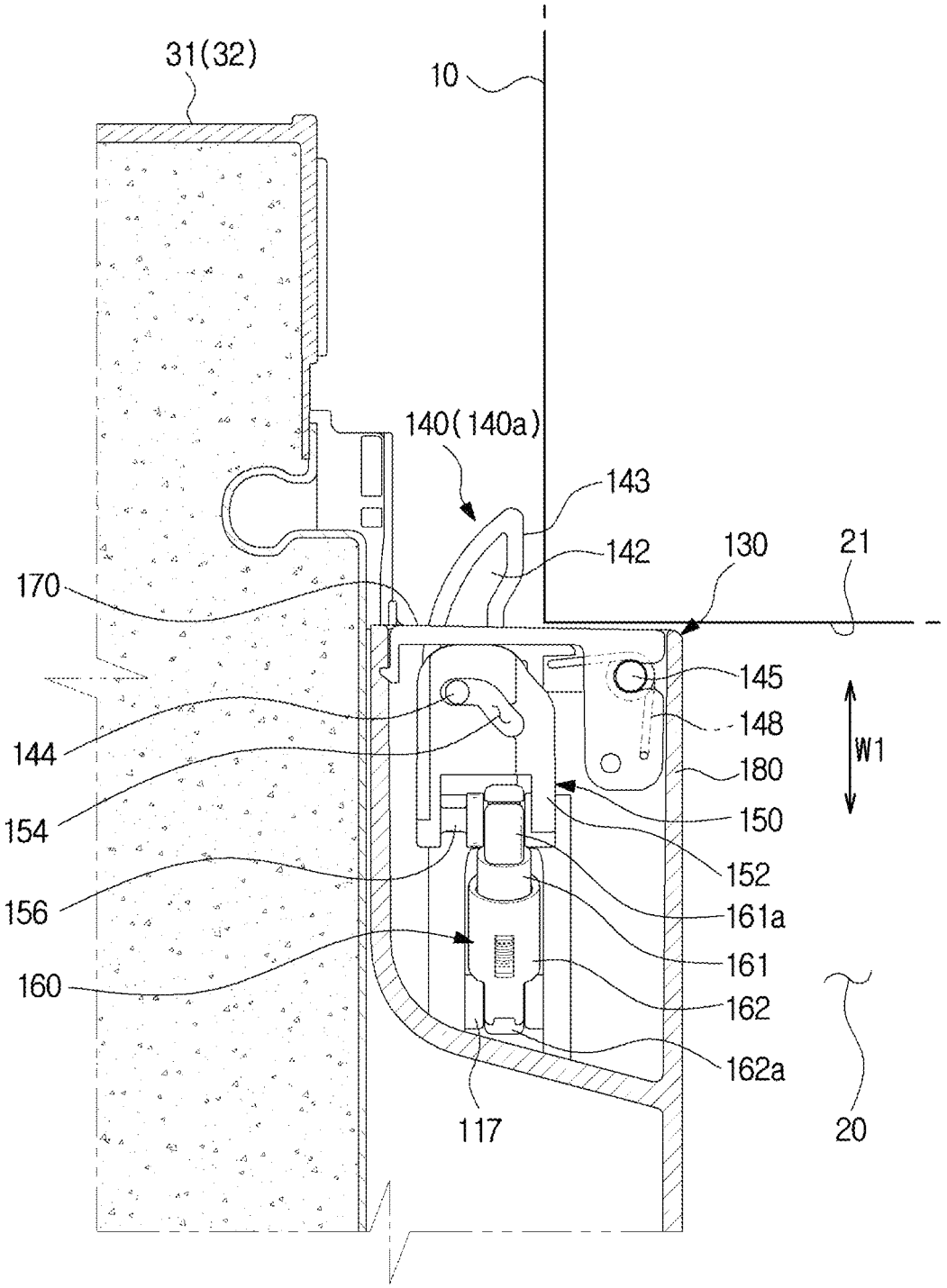
FIGS. 11, 12, 13 and 14 are views of operations of the bar assembly and the doors of the refrigerator according to an embodiment of the present disclosure.
Figure 12:
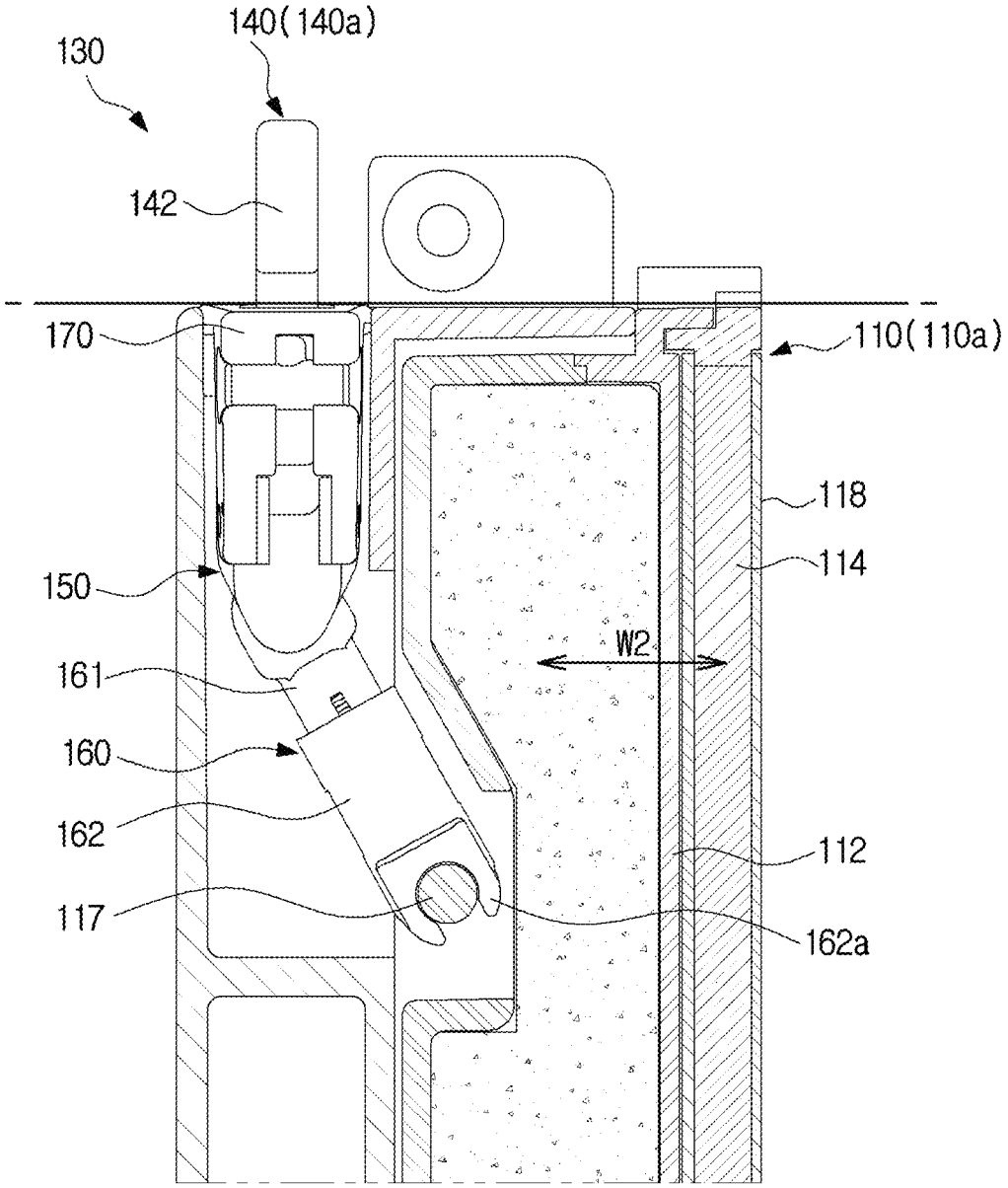

When the doors are at the opened position, the lever 140 is located at the lever standby position 140*a*, as illustrated in FIGS. 11 and 12. Here, the sliding bar 110 is located at the standby position 110*a* and is accommodated in the accommodation space 183 of the housing 180, as illustrated in FIG. 9.

When the doors are at positions immediately in front of the closed position, the pressed surface 143 of the lever 140 abuts the main body of the refrigerator, as illustrated in FIGS. 11 and 12.

Figure 13:
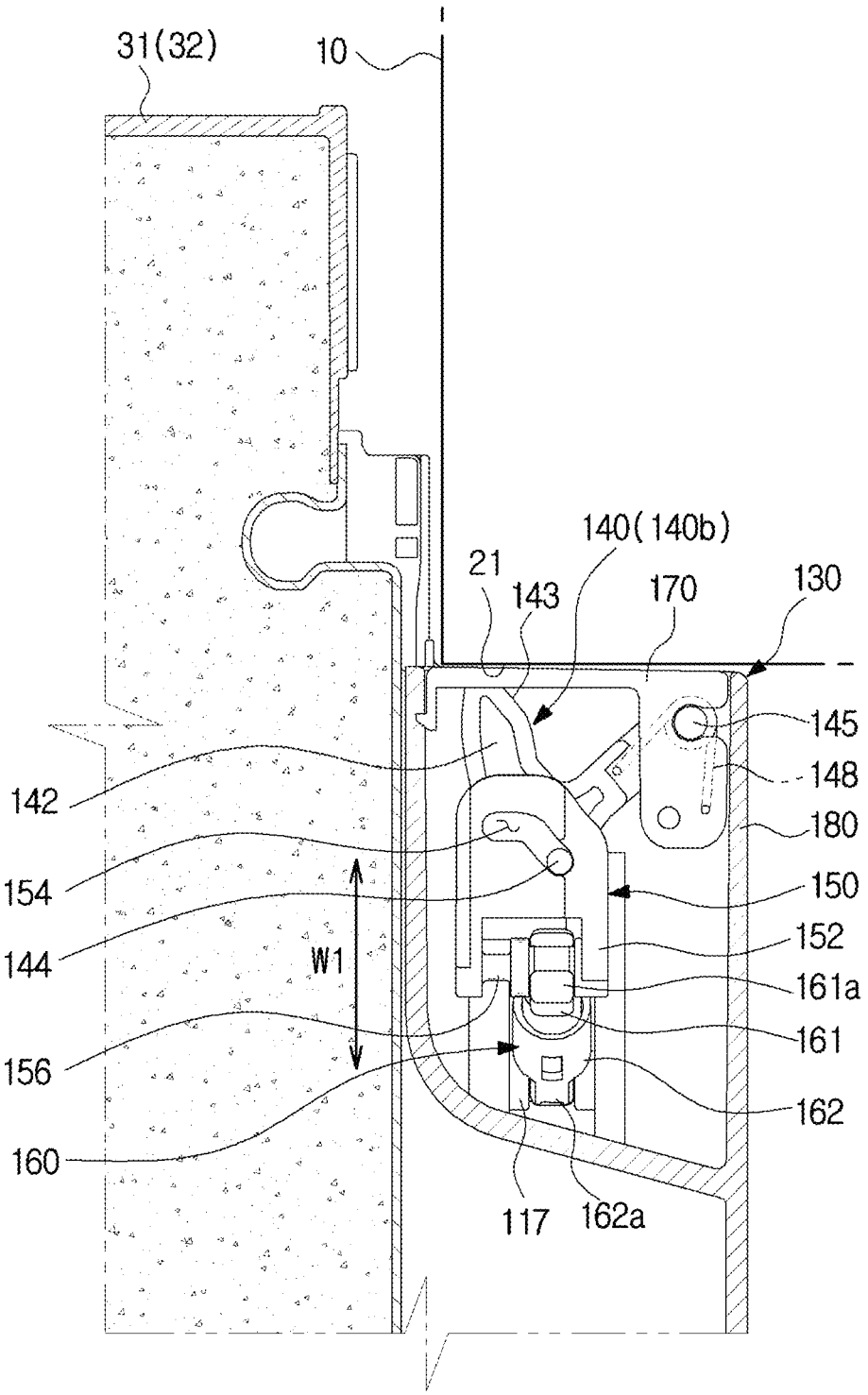
Figure 14:
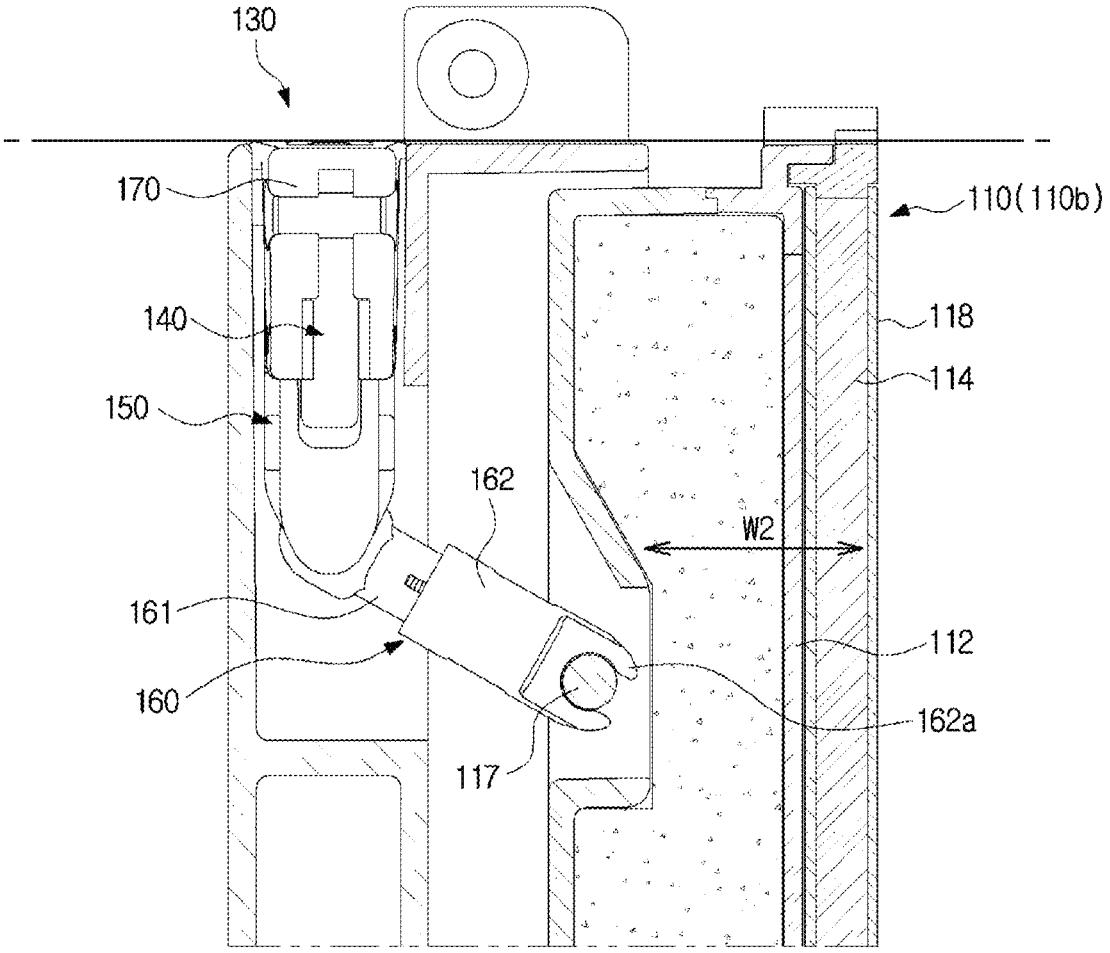

When the doors move to the closed position, the lever 140 is pressed by the main body 10 of the refrigerator, as illustrated in FIGS. 13 and 14, and rotates about the lever rotating shaft 145 to move from the lever standby position 140*a* to the lever pressing position 140*b*.

The lever 140 presses the intermediate link 150 by moving from the lever standby position 140*a* to the lever pressing position 140*b*, and the intermediate link 150 moves in the first direction W1.

One side of the sliding link 160 moves in the first direction W1 along with the intermediate link 150, and the other side of the sliding link 160 moves in the second direction W2.

Due to the other side of the sliding link 160 moving in the second direction W2, the sliding bar 110 moves from the standby position 110*a* to the contact position 110*b*.

When both the first door 31 and the second door 32 move to the closed position, the contact surfaces 118 of the sliding bars 110 may abut each other and a gap between the doors may be filled by the sliding bars 110. Through such a configuration, the storage compartment 20 may be sealed.

In the above process, because the sliding bars 110 operate in linkage with the operations of opening and closing the doors instead of being operated by directly receiving a pressing force from the main body 10, noise caused by the operation of the sliding bar 110 may be reduced in comparison to a rotary bar. Also, because the front-rear thickness of the sliding bar 110 may be increased, capacity of the insulation material 113 may be increased, and thus insulation performance may be improved.

Hereinafter, a refrigerator according to another embodiment of the present disclosure will be described. Descriptions of elements that have been described above will be omitted.

Figure 15:
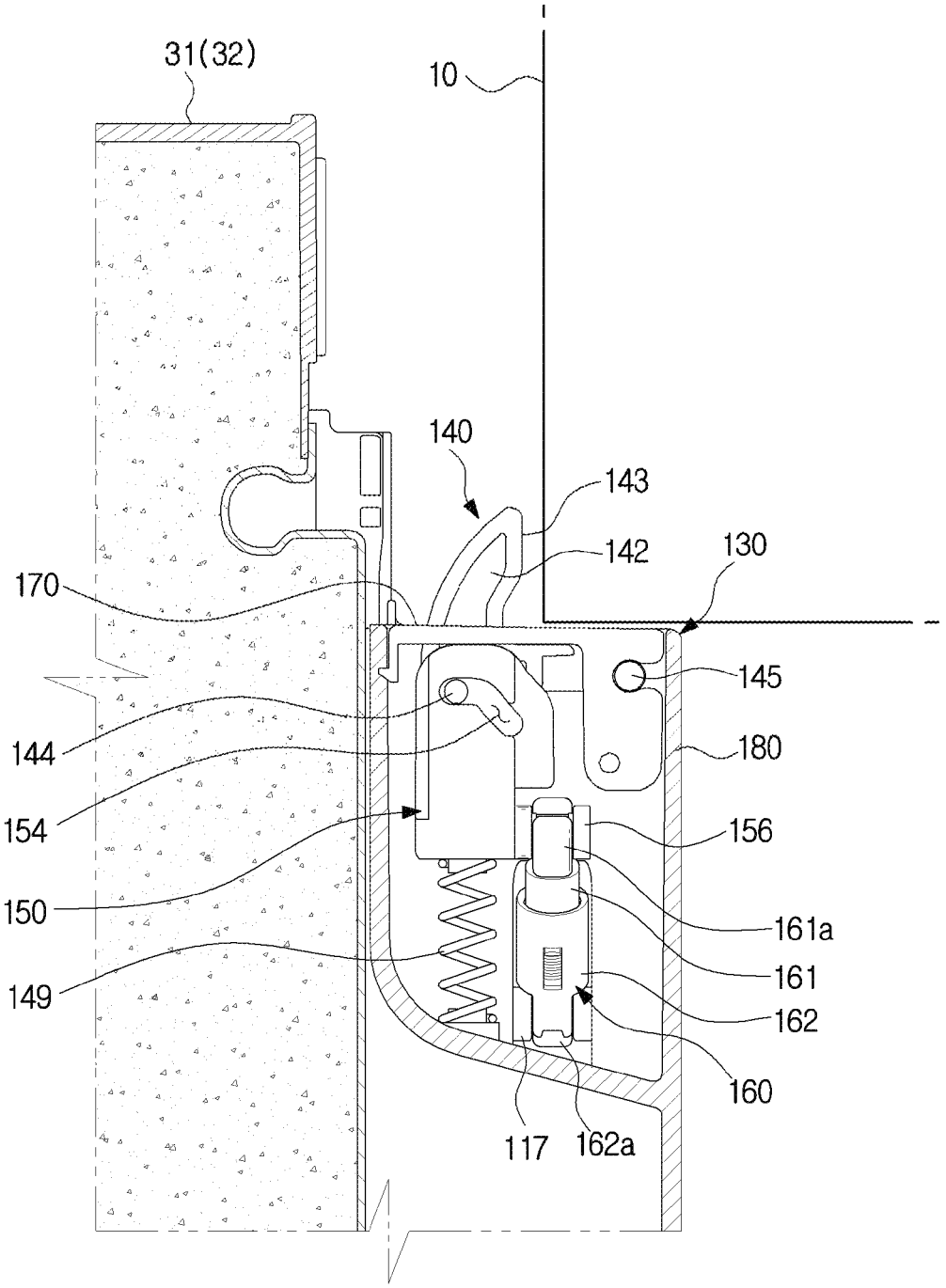
FIG. 15 is a view of a moving device of a refrigerator according to another embodiment of the present disclosure.

FIG. 15 is a view of a moving device of the refrigerator according to the other embodiment of the present disclosure.

The moving device 130 may include a device elastic member 149. In the present embodiment, the device elastic member 149 may be configured so that the intermediate link 150 has an elastic force in the first direction W1. Through this configuration, when the doors 31 and 32 are open, a restraint on the lever 140 by the inner wall 21 of the storage compartment 20 is released, and the intermediate link 150 returns the lever 140 from the lever pressing position 140*b* to the lever standby position 140*a* by an elastic restoration force of the device elastic member 149 in the first direction W1.

As should be apparent from the above description, a refrigerator of the present disclosure can minimize noise during operations of opening and closing doors.

Further, the present disclosure can be applied to various sized refrigerators because a moving distance of sliding bars can be adjusted in accordance with a change in a distance between the doors.

Further, the present disclosure can improve insulation performance by reducing limitations on a thickness of the sliding bar.

Further, a lifespan of the refrigerator can be extended by minimizing interference between the sliding bars during the operations of opening and closing the doors.

Further, damage due to an external environment can be minimized by preventing the sliding bars from being exposed outside when a storage compartment is open.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body having a storage compartment;

a pair of doors configured to open and close the storage compartment;

a sliding bar provided in each of the pair of doors, each sliding bar being configured to move in a first direction between a standby position and a contact position to which the sliding bar moves from the standby position to seal a gap between the pair of doors; and a moving device configured to operate the sliding bar in cooperation with operations of opening and closing the doors, wherein the moving device includes:

a lever mounted for rotation about an axis inside each door and configured to rotate about the axis when pressed by the main body as the door is closed to transmit a pressing force to the sliding bar in each door; and a sliding link configured to operate in cooperation with rotation of the lever and configured so that the sliding bar moves between the standby position and the contact position, wherein the first direction, in which each sliding bar moves between the standby position and the contact position, extends along the axis of rotation of the lever.

2. The refrigerator of claim 1, wherein:

the moving device further includes an intermediate link configured to operate in cooperation with the lever and provided to be movable in a second direction perpendicular to the axis of rotation of the lever when pressed by the main body; and the sliding link is configured to convert movement of the intermediate link in the second direction into movement in the first direction in which the sliding bar moves between the standby position and the contact position.

3. The refrigerator of claim 2, wherein the sliding link has one end rotatably provided in the intermediate link and an other end rotatably provided in the sliding bar.

4. The refrigerator of claim 2, wherein the sliding bar remains parallel to the first direction.

5. The refrigerator of claim 2, wherein the sliding link includes:

a first link rotatably provided in the intermediate link;

a second link configured to move relative to the first link; and a link elastic member configured to generate an elastic force in a longitudinal direction in the sliding link between the first link and the second link.

6. The refrigerator of claim 2, wherein the moving device further includes a lever elastic member provided to elastically return the lever and configured to generate an elastic restoration force in the second direction when the storage compartment is closed by the doors.

7. The refrigerator of claim 2, wherein the moving device further includes an elastic member provided to elastically return the intermediate link and configured to generate an elastic restoration force in the second direction when the storage compartment is closed by the doors.

8. The refrigerator of claim 1, wherein the lever is configured so that movement thereof is limited by an inner wall of the storage compartment when the storage compartment is closed by the doors.

9. The refrigerator of claim 1, wherein:

the sliding bar includes a pair of sliding bars respectively provided in the pair of doors; and the pair of sliding bars include first and second magnets disposed at opposite surfaces to come into contact with each other at the contact position.

10. The refrigerator of claim 9, wherein the first and second magnets are configured to be spaced a predetermined distance apart from each other at the contact position.

11. The refrigerator of claim 1, further comprising:

a housing forming a containing space so that the sliding bar is contained therein at the standby position; and a sealing rib configured to divide the containing space.

12. The refrigerator of claim 11, wherein the sealing rib extends in a longitudinal direction of the sliding bar and the housing and has one side fixed to the housing and an other side fixed to the sliding bar.

13. The refrigerator of claim 12, wherein the sealing rib is provided to bend in accordance with whether the sliding bar is at the standby position or the contact position.

14. A refrigerator comprising:

a main body having a storage compartment;

a pair of doors configured to open and close the storage compartment;

a sliding bar provided in each of the pair of doors, each sliding bar configured to move in a first direction between a standby position and a contact position to which the sliding bar moves from the standby position to seal a gap between the pair of doors; and a moving device provided in the doors to operate the sliding bar in cooperation with operations of opening and closing the doors, wherein the moving device includes:

a lever mounted for rotation about an axis inside each door and configured to rotate about the axis when pressed by the main body as the door is closed to transmit a pressing force to the sliding bar in each door;

an intermediate link configured to operate in cooperation with the lever and provided to be movable in a second direction perpendicular to the axis of rotation of the lever when pressed by the main body; and a sliding link configured to operate in cooperation with the intermediate link and convert a pressing force transmitted in the second direction into movement in the first direction to move the sliding bar in the second first direction, wherein the first direction, in which each sliding bar moves between the standby position and the contact position, extends along the axis of rotation of the lever.

15. The refrigerator of claim 14, wherein the sliding link has one end rotatably provided in the intermediate link and an other end rotatably provided in the sliding bar.

16. The refrigerator of claim 14, wherein the sliding bar is configured to move between the standby position at which the sliding bar is accommodated in the doors when the storage compartment is opened and the contact position to which the sliding bar moves from the standby position in the first direction to protrude from the doors when the storage compartment is closed.

17. The refrigerator of claim 14, wherein the sliding bar remains parallel to the first direction.

18. The refrigerator of claim 14, wherein:

the doors include an outer case and an inner case coupled to the outer case and having at least a portion accommodated in the storage compartment when the storage compartment is closed by the doors; and the lever is provided to protrude higher than the portion of the inner case accommodated in the storage compartment and provided so that an operation thereof is restrained by an inner wall of the storage compartment in the storage compartment closed by the doors.

19. A refrigerator comprising:

a main body having a storage compartment; and a pair of doors configured to open and close the storage compartment and having a bar assembly provided in each of the pair of doors and configured to fill a space between the pair of doors when the storage compartment is closed by the doors, wherein each bar assembly includes:

a housing forming a containing space;

a sliding bar configured to move in a first direction between a standby position at which the sliding bar is inserted into the containing space and a sealing position to which the sliding bar moves from the standby position to protrude from one door of the pair of doors toward an other door; and a sealing rib configured to connect an inner surface of the housing forming the containing space to the sliding bar and extending in a longitudinal direction of the bar assembly to divide the containing space; and a moving device including a lever mounted for rotation about an axis inside each of the doors and configured to rotate about the axis when pressed by the main body as the door is closed to transmit a pressing force to the sliding bar in each door, wherein the first direction in which each sliding bar moves between the standby position and the sealing position extends along the axis of rotation of the lever.

20. The refrigerator of claim 19, wherein the sealing rib is provided to bend in accordance with whether the sliding bar is at the standby position or the sealing position.

* * * * *